United States Patent [19]

Beckett et al.

[11] 4,022,263

[45] May 10, 1977

[54] MAGNETICALLY ACTUATED CAT DOOR

[76] Inventors: Richard W. Beckett, 59 Sulgrave Lane, San Rafael, Calif. 94901; Marian P. McBride, 630 St. Francis Blvd., San Francisco, Calif. 94127; Michael B. Johnson, 2198 Rosita Ave., Santa Clara, Calif. 95050

[22] Filed: Sept. 2, 1976

[21] Appl. No.: 719,904

[52] U.S. Cl. ..... 160/92; 160/179; 160/180

[51] Int. Cl.[2] ..... E06B 3/32

[58] Field of Search ..... 160/179, 180, 92; 200/61.41, 61.42, 61.43, 61.83, 86 A; 335/205

[56] References Cited

UNITED STATES PATENTS

| | | | |
|---|---|---|---|
| 2,000,366 | 5/1935 | Victor | 160/92 |
| 2,748,854 | 6/1956 | Lynch | 160/179 |
| 2,801,410 | 7/1957 | Ikeuchi et al. | 200/61.42 |
| 2,832,406 | 4/1958 | Turenne | 160/179 |
| 3,096,815 | 7/1963 | May | 160/188 |
| 3,621,415 | 11/1971 | Bell | 335/205 |
| 3,627,959 | 12/1971 | Chopell | 335/205 |

*Primary Examiner*—Peter M. Caun
*Attorney, Agent, or Firm*—Robert G. Slick

[57] ABSTRACT

A magnetically actuated cat door is provided wherein the owner's cat can wear a magnet and go freely in and out of the door while other cats are effectively barred from entering.

5 Claims, 3 Drawing Figures

MAGNETICALLY ACTUATED CAT DOOR

SUMMARY OF THE INVENTION

Cat owners find that it is a nuisance to continually let the cat in and out of the house and frequently provide a door for the cat so the cat can come and go at will. Frequently such doors take the form of a series of triangular flexible members arranged to form an iris. A cat can easily push its way through the center of such an iris and it will spring back to keep out the weather.

One difficulty with such cat doors is that stray cats will frequently follow the owner's cat into the house. Accordingly, it would be highly desirable to provide a device which would allow the owner's cat to come and go but which would prevent stray cats from entering the house.

In accordance with the present invention, a very simple and inexpensive device is provided wherein the owner's cat can come and go at will, while stray cats are kept out. This is achieved by the use of a novel magnetically actuated door and wherein the cat wears a small magnet. It is obviously suitable for other pets.

Various additional features and objects of the invention will be brought out in the balance of the specification.

DESCRIPTION OF THE PREFERRED EMBODIMENTS

Figure 1:
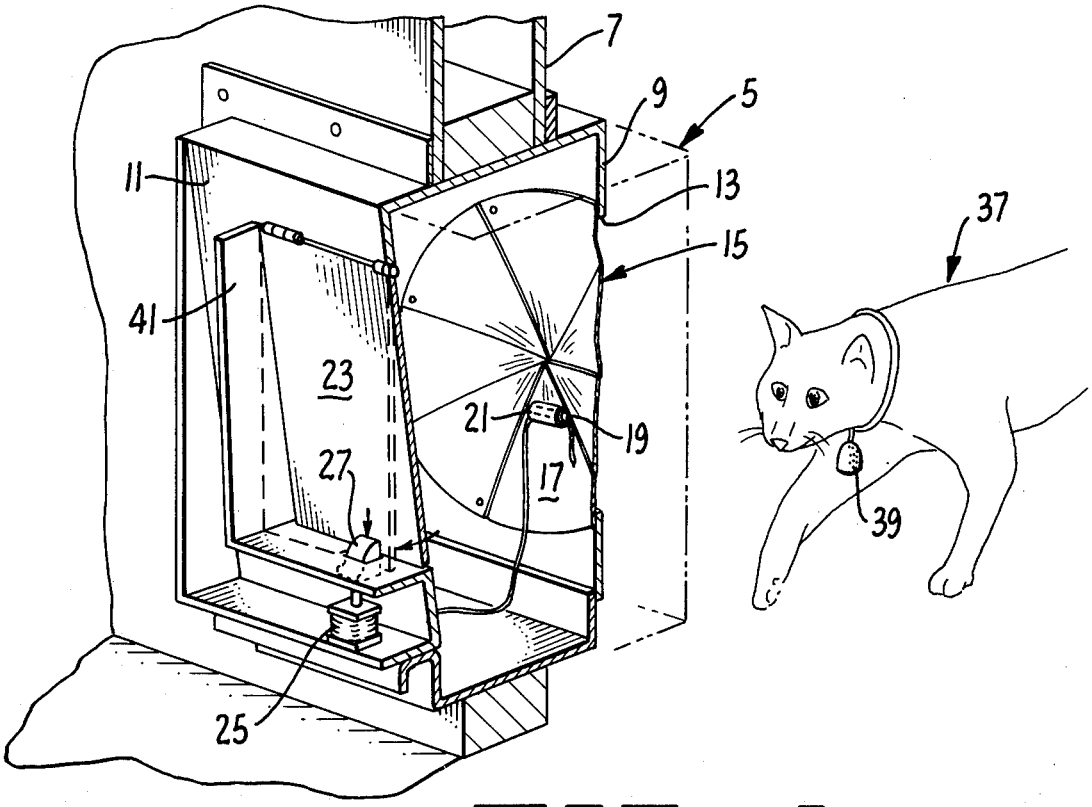
FIG. 1 is a perspective view, partly in section, of a novel cat door embodying the present invention.

Referring now to the drawings by reference characters, the structure of the present invention includes a box-like member generally designated 5 adapted to be inserted in the wall 7 of a dwelling. The box-like member has a front wall 9 and a back wall 11. The front wall 9 is provided with a circular opening 13 into which is fitted an iris generally designated 15. The iris 15 is composed of a plurality of triangular shaped panels 17 of a flexible material such as a plastic. Such iris structures are well known to those skilled in the art and they are sufficiently pliable so that a cat or similar animal can push the segments aside and enter and the iris will then spring back to form a closure to keep out the weather. In the present instance, the bottom segment 17 is provided with a magnetic reed switch 19. The switch 19 is of the normally open type and will close in the presence of a magnet. Reed switch 19 is enclosed in a tube 21 and is located within the tube so that the switch is relatively close to the front wall of the tube and is separated by some distance from the iris.

Figure 2:
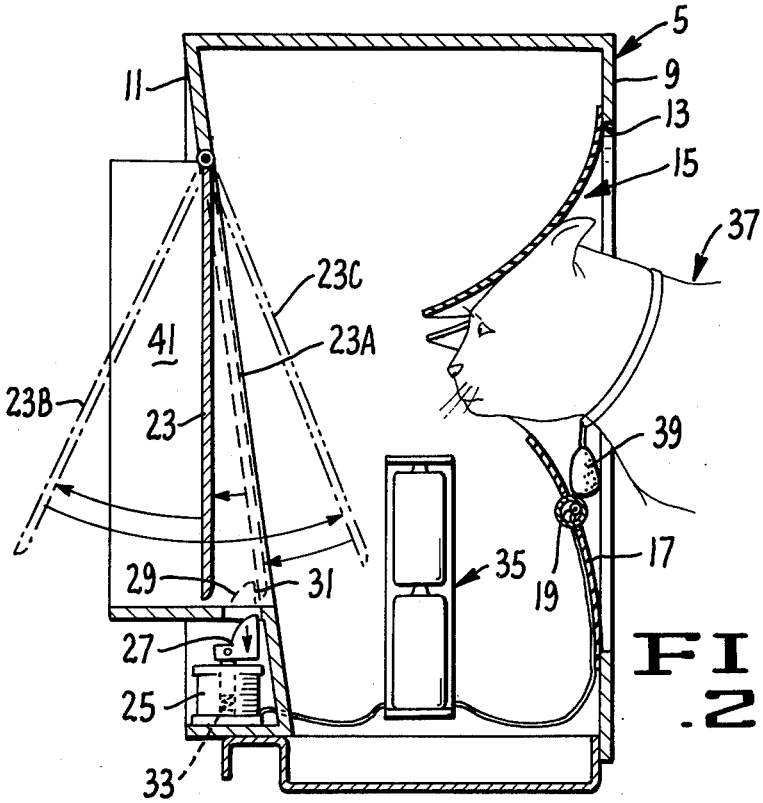
FIG. 2 is a section through the center of the door.
Figure 3:
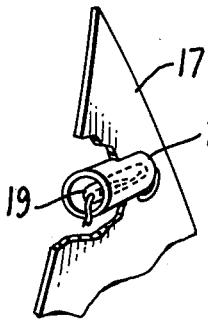
FIG. 3 is an enlarged detailed view showing the manner of fastening the reed switch to one of the iris sections.

In the back wall 11 is a swinging door 23; gravity normally holds the door in the position shown in solid lines in FIG. 2. Under the door is located a solenoid 25 having a catch 27 thereon. Catch 27 has a caming surface 29 at the rear of the door and a flat surface 31 toward the front of the door. The armature of the solenoid is normally biased in the up position by means of spring 33 so that if the current is not on, the solenoid remains in the position shown in dash lines of FIG. 2. When the solenoid 25 is energized, the catch 27 is drawn downwardly into the position shown in solid lines of FIG. 2. A suitable battery 35 is provided and the battery, solenoid 25 and switch 19 are wired in series. The owner's cat 37 is provided with a magnet 39. The magnet 39 is shown as a medallion hanging from a collar but it obviously can take various forms including the use of a collar of a ferrite-impregnated plastic which is magnetic.

At the start of a cycle, the door 23 is in the position shown in dash lines at 23A and is held in this position against the pull of gravity by catch 27. As the cat starts to enter the door as is shown in FIG. 2, magnet 39 causes switch 19 to close momentarily closing the circuit of the solenoid and pulling the catch 27 down. This permits the door 23 to move downwardly under the pull of gravity to the position shown in solid lines. Since the door is now free, the cat can push the door aside to the position shown in 23B or beyond to get into the house. As the cat leaves the box, the door 23 will be raised so high that gravity will swing it back through its center, depressing the catch 27 as it goes by and causing it to be caught in the position shown at 23A. In this position, the door is again locked so that a stray cat could not get in. On the other hand, if the cat desires to go out, the door can swing freely to the position shown at 23C so that the cat can leave. Of course, as the door swings back, it can only swing to the position shown in 23A so that another cat cannot get into the house.

As was pointed out previously, the magnetic reed switch 19 is located near the front of the tube 21 and spaced forward of the flap 17. Thus, the magnetic reed switch will not be actuated as the cat leaves, obviating the possibility that the door 23 might have swung to the position shown at 23A and then be released as the cat leaves. Holders of other shapes may be employed.

Preferably the back wall 11 has side extensions 41 at each side thereof. The reason for this is that cats have a tendency to go out the side of the door and it might be possible for the cat to get out of the door 23 without opening it sufficiently for gravity to cause it to swing back and actuate catch 27 and relock the door. By using the extensions or "blinders" at the opening, the cat is forced to go straight out for a sufficient distance to insure that the door 23 will swing far enough off center to swing back and catch.

Various departures can be made in the exact structure shown without departing from the spirit of this invention. For instance, the door 23 has been shown to be positioned by gravity, but a weak spring could be used to hold the door 23 against the catch 27 so that the door would be slightly opened when released by the catch, and then when it opened fully, gravity would cause it to overcome the force of the spring, allowing the door to recatch. Further, it is not necessary that the front door be an iris but any form of door capable of accomodating a magnetic switch could be employed. Although not shown, a clean-out drawer or tray can be provided at the bottom of the box for cleaning debris from the box. Obviously the doors must be spaced some distance apart for proper operation.

We claim:

1. An automatic door permitting ingress and egress of an animal wearing a magnet and not permitting such movement in the absence of a magnet, comprising in combination:

a. a chamber having a first wall representing the outside of a dwelling or the like and a second wall representing the inside wall of such a dwelling;

b. a door in said first wall, said door being openable by an animal pressing against the wall, c. a normally open magnet responsive switch in said door whereby an animal entering said door will cause said switch to close, d. a door in said second wall hinged from the top, said door being normally held in a closed position by a magnetic solenoid latch, e. biasing means, normally holding said door against said latch and preventing movement of the door;

f. power supply means in series with said magnetic switch and said solenoid whereby the presence of a magnet adjacent said magnetic switch will cause said solenoid to withdraw said latch, permitting said door to swing to a partially open position, g. said door being swingable to a fully opened position upon the passage of said animal, h. gravity causing said door upon being swung open to swing back and be recaught on said latch and i. said door being swingable toward said front wall to permit an animal to exit from said door.

2. The structure of claim 1 wherein the door in the front wall is in the form of an iris with the magnet responsive switch located on a leaf of the iris.

3. The structure of claim 2 wherein the switch is located in front of the iris whereby an animal pushing on the rear of the iris will not actuate the switch.

4. The structure of claim 1 wherein the biasing means is gravity.

5. The structure of claim 1 wherein the door in the rear wall is provided with extensions on each side thereof whereby an animal is forced to go out through the center of the door.

* * * * *